US009810054B2

(12) United States Patent
Patel

(10) Patent No.: US 9,810,054 B2
(45) Date of Patent: Nov. 7, 2017

(54) HYDRAULIC LOAD SENSOR SYSTEM AND METHODOLOGY

(71) Applicant: Schlumberger Technology Corporation, Sugar Land, TX (US)

(72) Inventor: Dinesh Patel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 82 days.

(21) Appl. No.: 14/912,146

(22) PCT Filed: Aug. 14, 2014

(86) PCT No.: PCT/US2014/050978

§ 371 (c)(1),
(2) Date: Feb. 15, 2016

(87) PCT Pub. No.: WO2015/023807

PCT Pub. Date: Feb. 19, 2015

(65) Prior Publication Data

US 2016/0201448 A1 Jul. 14, 2016

Related U.S. Application Data

(60) Provisional application No. 61/865,829, filed on Aug. 14, 2013.

(51) Int. Cl.

| | |
|---|---|
| ***E21B 47/06*** | (2012.01) |
| ***E21B 43/10*** | (2006.01) |
| ***E21B 47/00*** | (2012.01) |

(52) U.S. Cl.

CPC ..... *E21B 47/0006* (2013.01); *E21B 43/10* (2013.01); *E21B 47/06* (2013.01)

(58) Field of Classification Search

None

See application file for complete search history.

(56) References Cited

U.S. PATENT DOCUMENTS 4,624,311 A * 11/1986 Goad ..... E21B 23/04 166/125

4,880,257 A 11/1989 Holbert, Jr.

(Continued)

FOREIGN PATENT DOCUMENTS

WO 2012145735 A1 10/2012

WO 2015023807 A1 2/2015

OTHER PUBLICATIONS

International Search Report and Written Opinion for International Application No. PCT/US2014050978 dated Nov. 24, 2014.

*Primary Examiner* — Jill Culler

(57) ABSTRACT

A technique facilitates monitoring of load forces at various locations along a well string. The technique enables determination of loading based on measurement of hydraulic pressures, and the technique may be used to determine axial loading along a variety of downhole completions. A compensating piston may be disposed in a fluid chamber between a housing and a mandrel of one of the completions. The mandrel is slidably received in the housing and the fluid chamber is coupled with a sensor gauge via a pressure communication passage to facilitate accurate measurement of loading via the hydraulic pressures in the fluid chamber. The load forces may be monitored during, for example, landing of an uphole completion into a downhole completion. The sensor gauge also may be used for monitoring other pressures along the overall completion.

20 Claims, 6 Drawing Sheets

(56) References Cited

U.S. PATENT DOCUMENTS

| | | | | |
|---|---|---|---|---|
| 6,269,874 | B1 | 8/2001 | Rawson et al. | |
| 9,428,998 | B2 * | 8/2016 | Turley | E21B 43/10 |
| 2009/0321069 | A1 | 12/2009 | Jonas | |
| 2012/0267119 | A1 * | 10/2012 | Patel | E21B 34/10 166/373 |
| 2013/0075108 | A1 | 3/2013 | Frisby et al. | |

* cited by examiner

HYDRAULIC LOAD SENSOR SYSTEM AND METHODOLOGY

CROSS-REFERENCE TO RELATED APPLICATIONS

The present document is based on and claims priority to U.S. Provisional Application Ser. No. 61/865,829, filed Aug. 14, 2013, which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components including many types of sensor systems may be installed in the well. In certain applications, sensors are employed in the well completion components and/or at various locations along the well string to monitor parameters related to assembly and operation of the well completion system. Sensors also may be used to monitor fluid and/or environmental parameters. However, difficulties can arise in determining various loading and pressure related data during and after certain types of completion installation procedures and other well related procedures.

SUMMARY

In general, a system and methodology are provided for determining loading via pressure and/or for determining other pressures at various locations along a well string. The technique enables determination of loading via hydraulic pressures measured via a hydraulic load sensor system positioned along a completion system. In some applications, the loading is monitored, for example, during and after landing of an uphole completion into a downhole completion of an overall completion system. A compensating piston may be positioned to form a fluid chamber between a housing and a mandrel of a completion section. The mandrel is slidably received in the housing and the fluid chamber is coupled with a sensor gauge via a pressure communication passage to facilitate accurate measurement of pressures due to loading. Effectively, the load forces may be monitored via pressure sensors in the sensor gauge, but the sensor gauge also may be used for monitoring other pressures related to operation of the completion system.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for sensing parameters at a downhole location. A well string having a variety of completion components may incorporate a sensor or various sensors to monitor, for example, pressures related to loading which may occur during assembly and operation of the completion system. In some applications, the technique enables determination of load forces by monitoring hydraulic pressures during and after landing of an uphole completion into a downhole completion of an overall completion system. However, the lower and upper completions also may be run in a single trip, and the technique enables determination of the load forces at a select location or locations along the overall completion via monitoring of hydraulic pressures.

According to an embodiment, a completion system incorporates a hydraulic load sensor system. The hydraulic load sensor system comprises a compensating piston which may be positioned to form a fluid chamber between a housing and a mandrel of a completion. The compensating piston allows equalization of wellbore pressure with the pressure in the fluid chamber while the completion system is run in hole, e.g. run downhole into a wellbore. In some applications, the hydraulic load sensor system is located in an upper completion which is landed in a lower completion of the overall completion system. The mandrel is slidably received in the housing and the fluid chamber is coupled with a sensor gauge via a pressure communication passage to facilitate accurate measurement of loading based on hydraulic pressure in the fluid chamber. The loading may be monitored during, for example, landing of the uphole completion into the downhole completion. The sensor gauge also may be used for monitoring other pressures and/or other parameters during and after landing.

Figure 1:
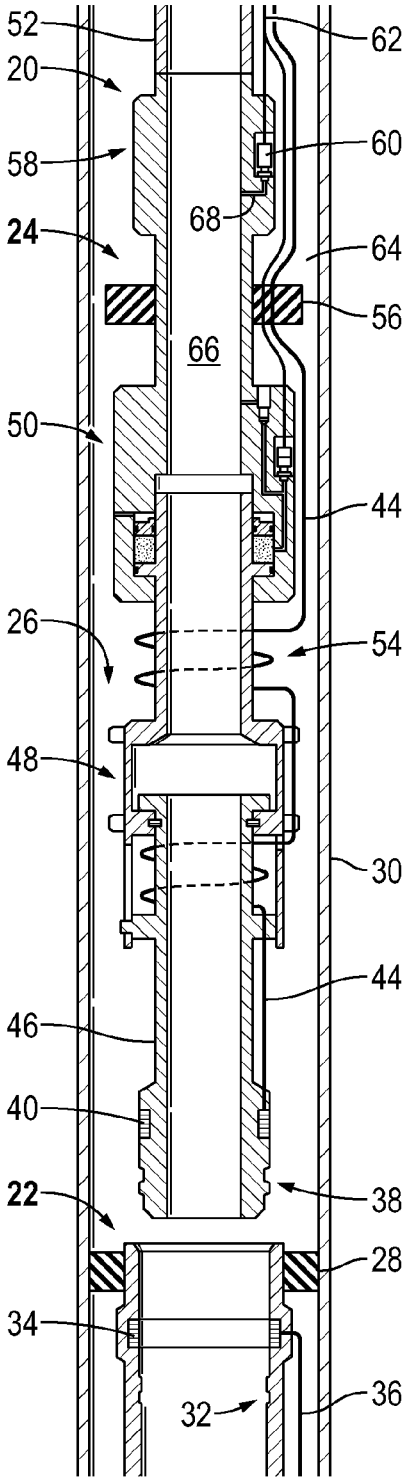
FIG. 1 is a schematic illustration of an example of a well system having a hydraulic load sensor system, according to an embodiment of the disclosure.

Referring generally to FIG. 1, an embodiment of a well completion system 20 is illustrated as comprising a lower completion 22 and an upper completion 24. The well completion system 20 is illustrated with various components, but a wide variety of other and/or additional components may be combined with the well completion system 20 depending on the specifics of a given well application.

In the embodiment illustrated, the lower completion 22 is initially run in hole. The lower completion 22 is moved downhole to a desired location in a wellbore 26 and anchored at the desired location by, for example, a packer 28. Depending on the application, the wellbore 26 may be lined with a casing 30 against which the packer 28 is set. In this example, the lower completion 22 further comprises a lower latch 32 and a female inductive coupler 34. A communication line 36, e.g. a twisted-pair cable or other suitable communication line, extends downwardly from the female inductive coupler 34 for connection to various components in lower completion 22 and/or components at other locations farther downhole. It should be noted that the lower completion 22 may comprise many additional components depending on the specifics of a given well application.

Figure 2:
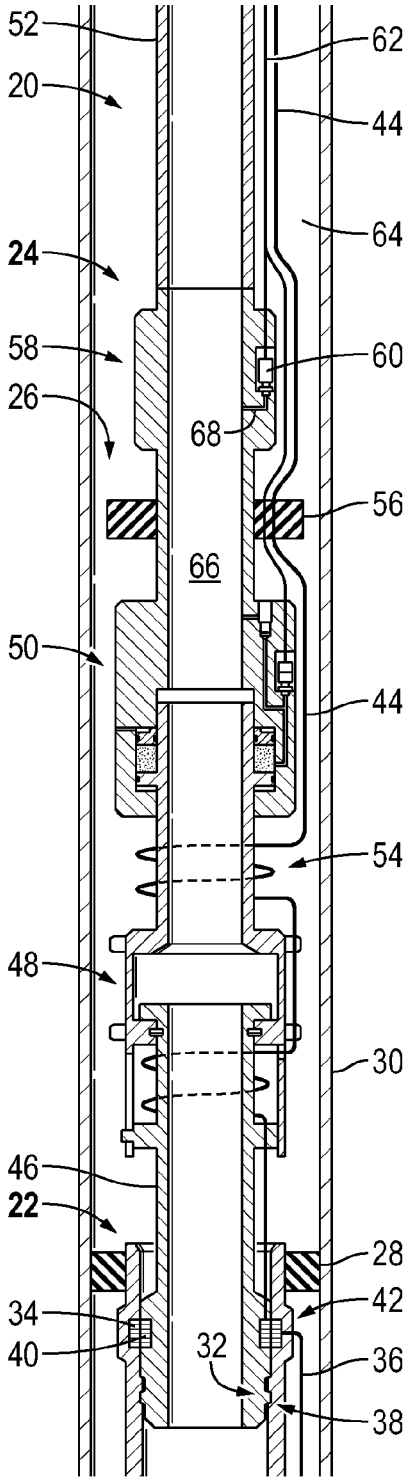
FIG. 2 is a schematic illustration of the well system illustrated in FIG. 1 but in a different operational position, according to an embodiment of the disclosure.

As further illustrated in FIG. 1, the upper completion 24 is moved downhole into wellbore 26 for engagement with the lower completion 22. In the example illustrated, the upper completion 24 comprises an upper latch 38 and a male inductive coupler 40 which are received and landed in lower latch 32 and female inductive coupler 34 of the lower completion 22, as illustrated in FIG. 2. Once the upper completion 24 is landed in lower completion 22, the female inductive coupler 34 and male inductive coupler 40 form an inductive coupler system 42 able to transfer data and/or power signals between the lower communication line 36 and an upper communication line 44, e.g. a twisted-pair cable or other suitable communication line, routed along upper completion 24.

In the example illustrated, the upper completion 24 comprises a tubing section 46 which extends from upper latch 38 to a contraction joint 48. The upper completion 24 further comprises a hydraulic load sensor system 50 which is illustrated as mounted above the contraction joint 48. However, the hydraulic load sensor system 50 may be mounted at other positions along upper completion 24, lower completion 22, or at other locations along the overall well string 52 into which the completion system 20 is coupled. Additionally, some applications may utilize a plurality of the hydraulic load sensor systems 50 disposed in specific completion sections or at other locations along the well string 52.

The upper completion 24 may comprise a variety of other components, including a cable wrap 54 of upper communication line 44 between hydraulic load sensor system 50 and contraction joint 48. In the illustrated example, the upper completion 24 further comprises a packer 56 and a sensor gauge 58 located above the packer 56. The sensor gauge 58 may comprise pressure and/or temperature sensors 60. The sensor or sensors 60 and the hydraulic load sensor system 50 may be connected by a communication line 62, e.g. a mono conductor, electric cable, or other suitable communication line, which may be routed uphole along the wellbore 26.

Depending on the application, the sensor or sensors 60 may be positioned to measure temperature and/or pressure at an external location 64 (e.g. a location external to the well string 52 within an annulus formed between the well string 52 and the casing 30) and/or along an interior passage 66 of the well string 52. By way of example, the sensor 60 may be exposed to pressures along the interior passage 66 of the well completion system 20 via a port or ports 68. In this example, sensor gauge 58 comprises a plurality of pressure sensors 60 configured to sense external pressure at exterior 64 and internal pressure at interior passage 66. The illustrated components of upper completion 24 are provided as examples and many other and/or additional components may be incorporated into the upper completion 24 according to the specifics of a given application.

Figure 3:
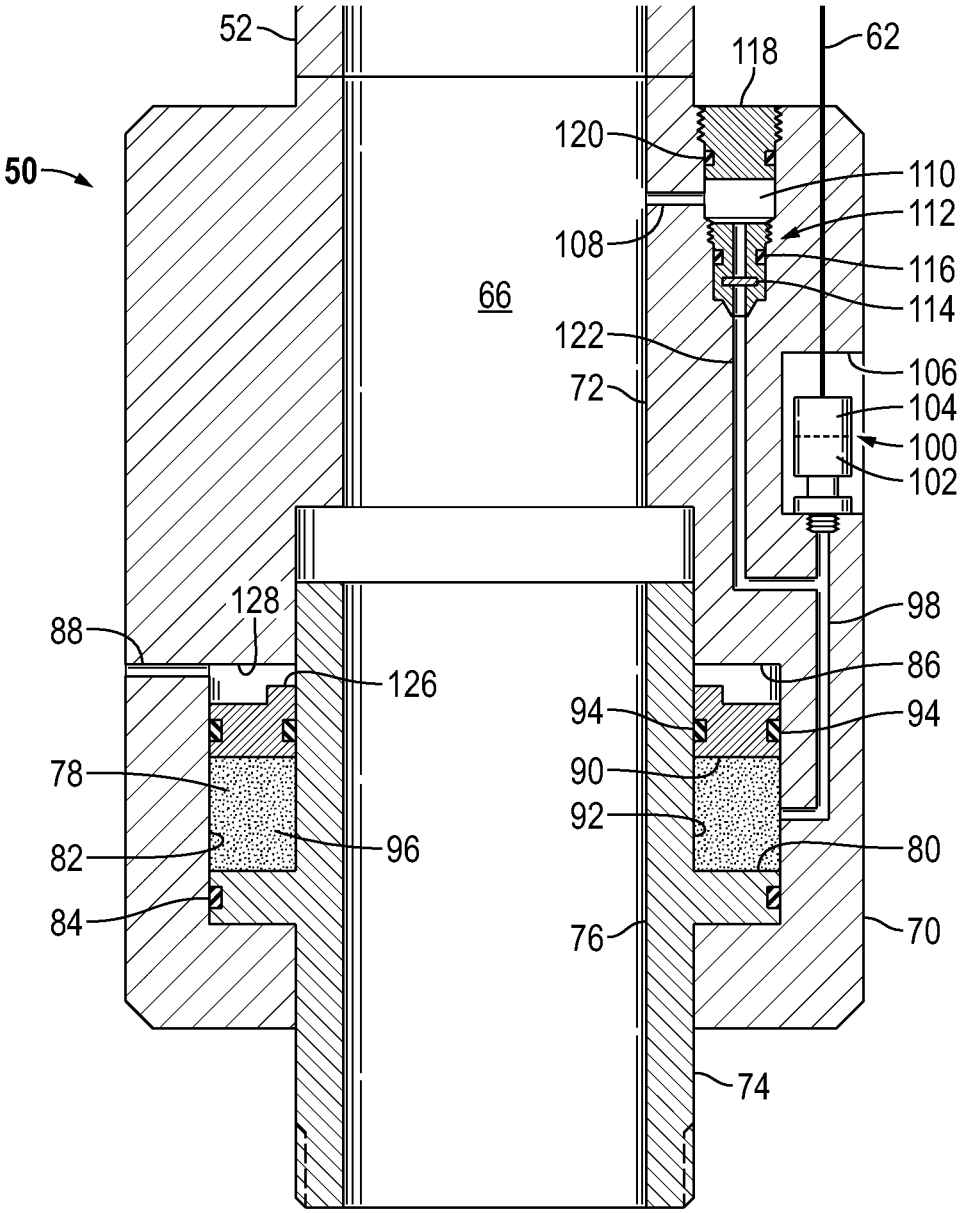
FIG. 3 is an enlarged schematic illustration of the hydraulic load sensor system illustrated in FIG. 1, according to an embodiment of the disclosure.
Figure 4:
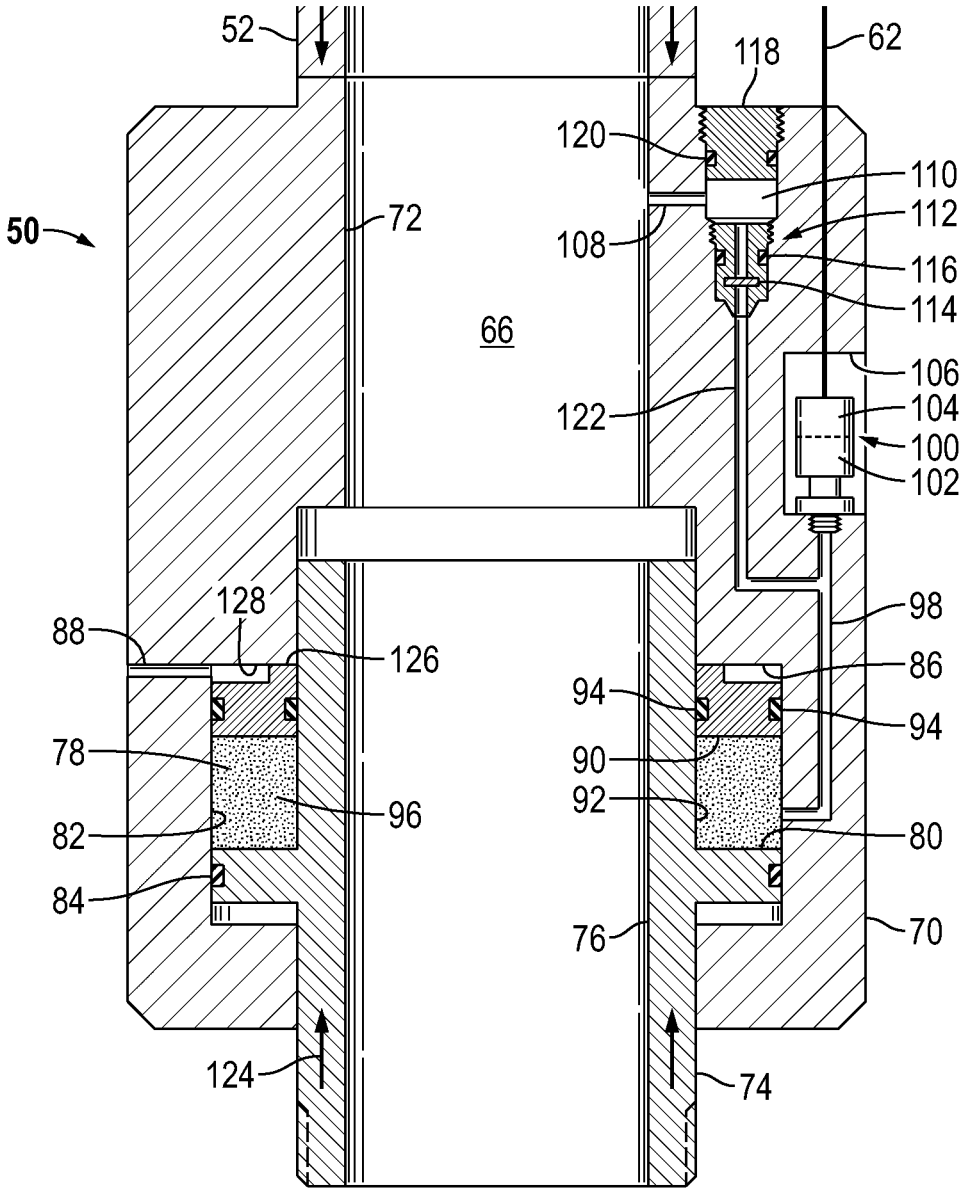
FIG. 4 is a schematic illustration similar to that of FIG. 3 but showing the hydraulic load sensor system in a different operational position, according to an embodiment of the disclosure.

Referring generally to FIGS. 3 and 4, enlarged views of the hydraulic load sensor system 50 are provided which illustrate the hydraulic load sensor system 50 in unloaded and loaded operational positions. In the embodiment illustrated, hydraulic load sensor system 50 comprises a housing 70 having an internal passage 72 generally aligned with and forming part of interior passage 66 extending along the interior of well completion system 20. The housing 70 slidably receives a mandrel 74 along the internal passage 72, and the mandrel 74 has a corresponding internal passage 76.

In the example illustrated, the mandrel 74 forms a pressure chamber or fluid chamber 78 with housing 70. For example, the mandrel 74 may comprise an expanded section 80 which is sealed to an internal surface 82 of housing 70 via a suitable seal 84. The internal surface 82 defines an external wall of an expanded recess 86 formed within housing 70. In this example, the expanded section 80 and seal 84 may slidably move along the internal surface 82 as the linear position of mandrel 74 is shifted with respect to housing 70. A wellbore pressure communication port 88 may extend through housing 70 between expanded recess 86 and the external location 64, e.g. annulus, surrounding housing 70. In this example, the expanded recess 86 is sealed between housing 70 and mandrel 74 except for access to external pressure via wellbore pressure communication port 88.

The fluid chamber 78 is formed within expanded recess 86 via a compensating piston 90 positioned in the expanded recess 86 between internal surface 82 of housing 70 and an external surface 92 of mandrel 74. The compensating piston 90 may be sealed with respect to internal surface 82 and external surface 92 via suitable seals 94. In this example, the compensating piston 90 is positioned in expanded recess 86 between the wellbore pressure communication port 88 and the expanded section 80 of mandrel 74 to create fluid chamber 78 between compensating piston 90 and expanded section 80. The fluid chamber 78 may be filled with a suitable liquid 96, such as oil. The compensating piston 90 can move within the expanded recess 86 to compensate for changes in volume of liquid 96 in fluid chamber 78 due to temperature and pressure changes. The compensating piston 90 also allows equalization of wellbore pressure with the pressure in fluid chamber 78 while the upper completion 24 is run in hole (or while the overall well completion system 20 is run in hole if the lower completion 22 and upper completion 24 are run downhole as a single unit).

In the embodiment illustrated, a pressure communication passage 98 extends from fluid chamber 78, at a location between expanded section 80 and compensating piston 90, to a sensor gauge 100. The sensor gauge 100 may comprise a pressure sensor or pressure sensors 102. In some applications, the sensor gauge 100 also may comprise a temperature sensor or temperature sensors 104. As illustrated, the sensor gauge 100 comprises a plurality of pressure sensors 102 positioned for exposure to pressures in fluid chamber 78 and to external pressures in the external location 64, e.g. annulus, surrounding well completion system 20. In some applications, the sensor gauge 100 may be positioned in a protective recess 106 formed in housing 70.

The hydraulic load sensor system 50 also may comprise a tubing pressure communication port 108 extending between interior passage 66 and an internal housing chamber 110. In this example, a rupture disk holder 112 and a corresponding rupture disk 114 are positioned in housing chamber 110 and sealed therein with a suitable seal 116. However, a variety of other frangible systems, valves, and other controlled pressure release mechanisms may be used to control the release of pressure upon sufficient pressure buildup at tubing pressure communication port 108. In the embodiment illustrated, the housing chamber 110 may be enclosed with a cap 118 and corresponding seal 120. The tubing pressure communication port 108 extends into the internal housing chamber 110 between the rupture disk 114 and the cap 118.

Additionally, a corresponding pressure communication passage 122 extends from housing chamber 110 into cooperation with sensor gauge 100. As illustrated, the corresponding pressure communication passage 122 may extend into housing chamber 110 on an opposite side of rupture disk 114 relative to tubing pressure communication port 108. An opposite end of the corresponding pressure communication passage 122 may join pressure communication passage 98 which extends to sensor gauge 100, as illustrated.

FIG. 3 illustrates the hydraulic load sensor system 50 in a configuration prior to landing of upper completion 24 into lower completion 22 (see FIG. 1), e.g. while running in hole. However, FIG. 4 illustrates the hydraulic load sensor system 50 in a configuration after landing of upper latch 38 and male inductive coupler 40 into lower latch 32 and female inductive coupler 34 and after slacking off weight with respect to the upper completion 24. As illustrated, the slacking off of weight causes an upwardly directed force to act on mandrel 74 from the component positioned beneath mandrel 74, as represented by arrows 124. Arrows 124 represent the axial loading incurred at mandrel 74 during various stages of slacking off weight with respect to the upper completion 24. This axial loading force 124 may be determined via the pressure in fluid chamber 78, as measured by sensor gauge 100, so as to enable monitoring of the loading during landing and during other stages of operation.

The load force 124 causes mandrel 74 to shift farther into housing 70 as expanded section 80 slides along internal surface 82. The movement of mandrel 74 relative to housing 70 increases the pressure in fluid chamber 78 which shifts the compensating piston 90. However, movement of the compensating piston 90 is limited and blocked once an abutment surface 126 of compensating piston 90 reaches a corresponding abutment surface 128 of housing 70. By way of example, the corresponding abutment surface 128 may be a longitudinal end surface defining a longitudinal extent of the expanded recess 86.

As a result of abutment surface 126 engaging corresponding abutment surface 128, the upper completion slack off weight is supported by compensating piston 90. Consequently, the pressure in fluid chamber 78 equals the wellbore pressure acting on compensating piston 90 via the wellbore pressure communication port 88 plus the pressure due to the set down weight exerted by the upper completion 24. The pressure due to the slack off weight, i.e. set down weight, is equal to the set down weight divided by the surface area acting on the liquid 96 in fluid chamber 78, e.g. the set down weight divided by the surface area of compensating piston 90 acting on liquid 96. Thus, the loading 124 due to the set down weight may be readily calculated from the measured hydraulic pressure in fluid chamber 78.

Figure 5:
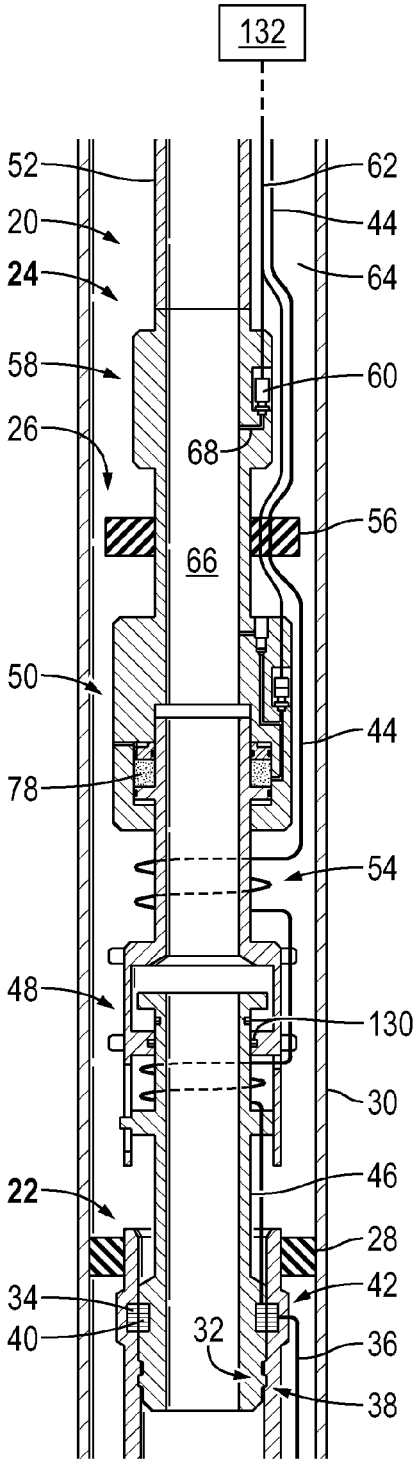
FIG. 5 is a schematic illustration of the well system illustrated in FIG. 2 but in a different operational position, according to an embodiment of the disclosure.
Figure 6:
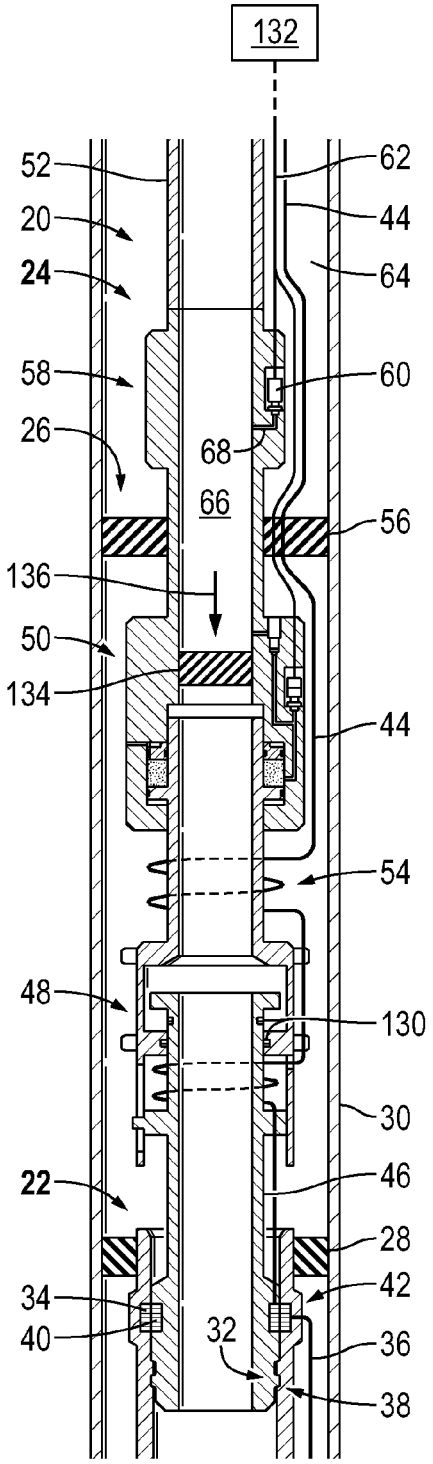
FIG. 6 is a schematic illustration of the well system illustrated in FIG. 5 but in a different operational position, according to an embodiment of the disclosure.

Referring generally to FIGS. 5 and 6, examples of subsequent stages of a downhole completion installation operation are illustrated. In FIG. 5, for example, the contraction joint 48 is activated by setting down sufficient weight on the contraction joint 48 to shear suitable shear members 130, e.g. shear pins. During this stage of the procedure, the set down weight may be monitored via the hydraulic load sensor system 50. As the set down weight acting on contraction joint 48 is increased, the pressure of liquid 96 in fluid chamber 78 also increases and this increased pressure is relayed to sensor gauge 100 via pressure passage 98.

The pressure data monitored by sensor gauge 100 may be relayed to a suitable control system 132, e.g. a microprocessor-based control system located at the surface. The control system 132 can be used to automatically calculate the set down weight and thus the load forces 124 based on the known external wellbore pressure, pressure in chamber 78, and the surface area acting on liquid 96 in fluid chamber 78. The external wellbore pressure may be determined from suitable pressure sensors, e.g. pressure sensors 102, located in sensor gauge 100 and exposed to the external/annulus region 64. Control system 132 may be used at various stages to determine loading and changes in loading along the completion system 20, e.g. along upper completion 24 at hydraulic load sensor system 50.

Figure 7:
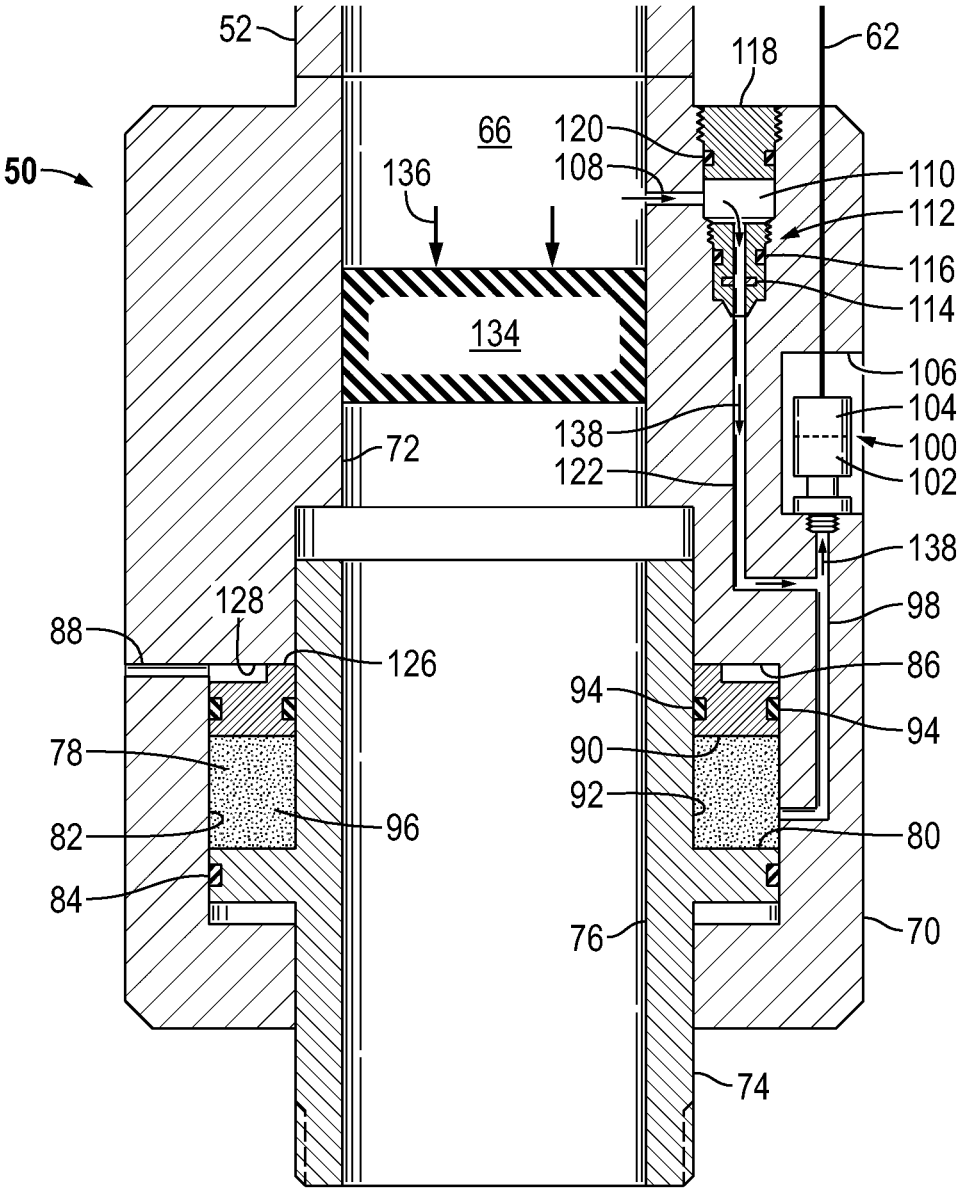
FIG. 7 is an enlarged schematic illustration of the hydraulic load sensor system illustrated in FIG. 6, according to an embodiment of the disclosure.

In the stage illustrated in FIG. 6, a plug 134 is pumped down or otherwise run along interior passage 66 until seated. The plug 134 may be seated in internal passage 72 of housing 70 at a position beneath port 108. Pressure is applied along the interior 66 of the well tubing string 52, as represented by arrow 136, and this pressure may be used to set packer 56. However, the pressure also acts against rupture disk 114 via port 108 and chamber 110. The pressure may be increased until rupture disk 114 ruptured, as illustrated in FIG. 7. Once rupture disk 114 is ruptured, pressure is communicated between port 108 and sensor gauge 100 via corresponding pressure communication passage 122, as indicated by arrows 138. At this stage, the sensors in sensor gauge 58 above packer 56 and in sensor gauge 100 may be used to monitor both internal tubing pressures at interior passage 66 and external reservoir/wellbore pressures in the external/annulus location 64.

Figure 8:
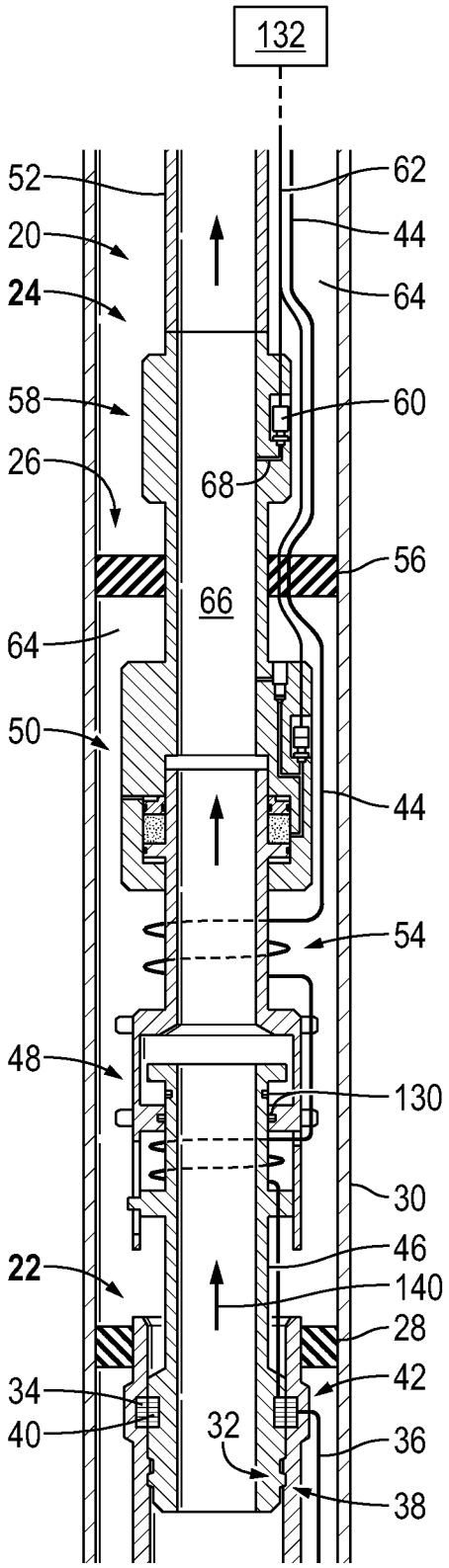
FIG. 8 is a schematic illustration of the well system illustrated in FIG. 6 but in a different operational position, according to an embodiment of the disclosure.

Subsequently, plug 134 may be removed to open the internal tubing passage 66, as illustrated in FIG. 8. In this example, each of the sensor gauges 58 and 100 may comprise pressure sensors 60, 102 selected for monitoring both the internal and external pressures. In production operations, the internal and external pressures may be monitored via control system 132 in zones above and below packer 56 while reservoir fluids are produced to the surface or other suitable location, as indicated by arrows 140 in FIG. 8.

The well completion system 20 may be used in a variety of applications, including numerous types of well production applications, treatment applications, testing applications, and/or other types of well applications. Depending on the specifics of a given well application and environment, the construction of the overall well completion system 20 as well as the construction and configuration of the hydraulic load sensor system 50 may vary. For example, the hydraulic load sensor system 50 may be used at a variety of locations along the well string 52 and at various zones along the wellbore 26. Additionally, the hydraulic load sensor system 50 may comprise different numbers and types of sensors and may be used in cooperation with other sensors, e.g. sensors 60, disposed along the well string 52.

Depending on the application, the hydraulic load sensor system 50 may comprise several types of components and configurations. For example, the housing 70 and mandrel 74 may have a variety of configurations and may be movably coupled with each other according to a variety of techniques. In some applications, a lower surface of the housing 70 may be constructed as a shoulder for supporting hanging weight.

Additionally, the compensating piston, pressure communication passages, pressure release mechanisms, e.g. rupture disk 114 or other suitable pressure release mechanisms, sensor gauges, and other components may be constructed and used in cooperation according to various configurations of the overall load sensor system 50. Similarly, the gauge sensor 100 may comprise pressure sensors, temperature sensors, and/or other types of sensors for monitoring a variety of downhole parameters.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for monitoring downhole parameters, comprising:

a completion system deployed in a wellbore, the completion system having a hydraulic load sensor system, the hydraulic load sensor system comprising:

a housing;

a mandrel slidably received in the housing;

a compensating piston positioned between the housing and the mandrel in an expanded recess formed between the housing and the mandrel, the compensating piston being positioned to form a fluid chamber;

a sensor gauge able to monitor pressure in the fluid chamber via a pressure communication passage extending from the fluid chamber to the sensor gauge; and a wellbore pressure communication passage in communication between a wellbore and the expanded recess on an opposite side of the compensating piston relative to the fluid chamber, the pressure in the fluid chamber as measured by the sensor gauge being used to determine axial loading.

2. The system as recited in claim 1, wherein the hydraulic load sensor system further comprises a second pressure communication passage extending between an interior of the upper completion and the sensor gauge.

3. The system as recited in claim 2, wherein a rupture member is disposed along the second pressure communication passage.

4. The system as recited in claim 3, wherein the completion system comprises a lower completion and an upper completion received in the lower completion, the compensating piston being moved against an abutment surface as the mandrel shifts relative to the housing during axial loading of the mandrel by slacking off weight on the upper completion, the slack off weight of the upper completion being supported by the compensating piston.

5. The system as recited in claim 4, wherein the upper completion comprises a packer disposed on an opposite side of the hydraulic load sensor system relative to the lower completion.

6. The system as recited in claim 5, wherein the upper completion further comprises a second sensor gauge disposed on an opposite side of the packer relative to the hydraulic load sensor system.

7. The system as recited in claim 6, wherein the second sensor gauge comprises pressure sensors exposed to internal pressure within the upper completion and to external pressure in an annulus surrounding the upper completion.

8. The system as recited in claim 7, wherein the sensor gauge comprises pressure sensors exposed to internal pressure within the hydraulic load sensor system after rupture of the rupture member and to external pressure in the annulus surrounding the upper completion.

9. The system as recited in claim 1, wherein the compensating piston compensates for changes in fluid volume in the fluid chamber.

10. A device for sensing loading, comprising:

a hydraulic load sensor system having:

a housing;

a mandrel slidably received in the housing;

a compensating piston positioned between the housing and the mandrel in an expanded recess formed between the housing and the mandrel, the compensating piston being positioned to form a fluid chamber which is closed by the compensating piston;

a sensor gauge able to monitor pressure in the fluid chamber via a pressure communication passage extending from the fluid chamber to the sensor gauge; and a pressure communication port in communication between a region external to the housing and the expanded recess on an opposite side of the compensating piston relative to the fluid chamber.

11. The device as recited in claim 10, wherein the sensor gauge comprises a plurality of pressure sensors and temperature sensors.

12. The device as recited in claim 10, wherein the sensor gauge comprises pressure sensors for monitoring the pressure in the fluid chamber and for monitoring external pressure at a location along the exterior of the housing.

13. The device as recited in claim 12, wherein the sensor gauge comprises pressure sensors for monitoring pressure along an interior passage of the hydraulic load sensor system.

14. The device as recited in claim 10, further comprising a processor system coupled with the sensor gauge to determine loading on the mandrel based on pressure in the fluid chamber resulting from exposing the compensating piston to pressure from the region external to the housing and due to loading of the compensating piston via movement of the mandrel into the housing.

15. The device as recited in claim 10, further comprising a second pressure communication passage extending between an interior of the housing and the sensor gauge.

16. The device as recited in claim 10, further comprising a rupture member disposed in the second pressure communication passage.

17. A method for controlling flow, comprising:

positioning a first completion downhole in a wellbore;

conveying a second completion downhole into the wellbore and landing the second completion in the first completion;

using a hydraulic load sensor system to monitor loading along the second completion using a compensating piston to create pressure in a fluid chamber which accounts for external wellbore pressure and pressure due to the loading;

monitoring the pressure in the fluid chamber via a sensor gauge; and outputting data from the sensor gauge to a control system which processes the data to obtain the level of axial loading at the hydraulic load sensor system.

18. The method as recited in claim 17, wherein using comprises using the hydraulic load sensor system to determine axial loading during landing of the second completion into the first completion.

19. The method as recited in claim 17, wherein using comprises using the hydraulic load sensor system to determine axial loading during shearing of a shear member disposed in the second completion.

20. The method as recited in claim 17, further comprising monitoring internal and external pressures with the sensor gauge during a production operation following landing of the second completion in the first completion.

* * * * *